United States Patent [19]

Trauernicht et al.

[11] 4,414,437

[45] Nov. 8, 1983

[54] MOVING COIL DYNAMIC TRANSDUCER

[75] Inventors: Herbert Trauernicht, Wennigsen; Karl-Heinz Thiele, Peine-Stederdorf, both of Fed. Rep. of Germany

[73] Assignee: Licentia Patent-Verwaltungs-GmbH, Frankfurt am Main, Fed. Rep. of Germany

[21] Appl. No.: 212,280

[22] Filed: Dec. 2, 1980

[30] Foreign Application Priority Data

Dec. 6, 1979 [DE] Fed. Rep. of Germany ..... 2949115

[51] Int. Cl.[3] ..... H04R 9/04

[52] U.S. Cl. ..... 179/115.5 VC

[58] Field of Search ..... 179/115.5 R, 115.5 VC, 179/115.5 BS, 115.5 PV, 115 R–115 V, 181 R–181 W

[56] References Cited

U.S. PATENT DOCUMENTS

| | | | |
|---|---|---|---|
| 2,020,814 | 11/1935 | Van Uok et al. | 179/115.5 VC |
| 3,792,394 | 2/1974 | Bertagni | 179/115.5 VC X |
| 4,017,694 | 4/1977 | King | 179/115.5 VC |

*Primary Examiner*—Benjamin R. Fuller

*Attorney, Agent, or Firm*—Spencer, Kaye & Frank

[57] ABSTRACT

In an electromagnetic transducer including a member producing a magnetic field and presenting an air gap traversed by the field, a mass of magnetic liquid extending across the air gap, and a moving coil mounted on a moving coil carrier supported for movement through the air gap, the carrier is provided with at least one passage located to communicate with the magnetic liquid during at least part of the movement of the coil carrier through the air gap for permitting flow of magnetic liquid from one side to the other of the carrier in the direction of the air gap.

7 Claims, 3 Drawing Figures

FIG. 1
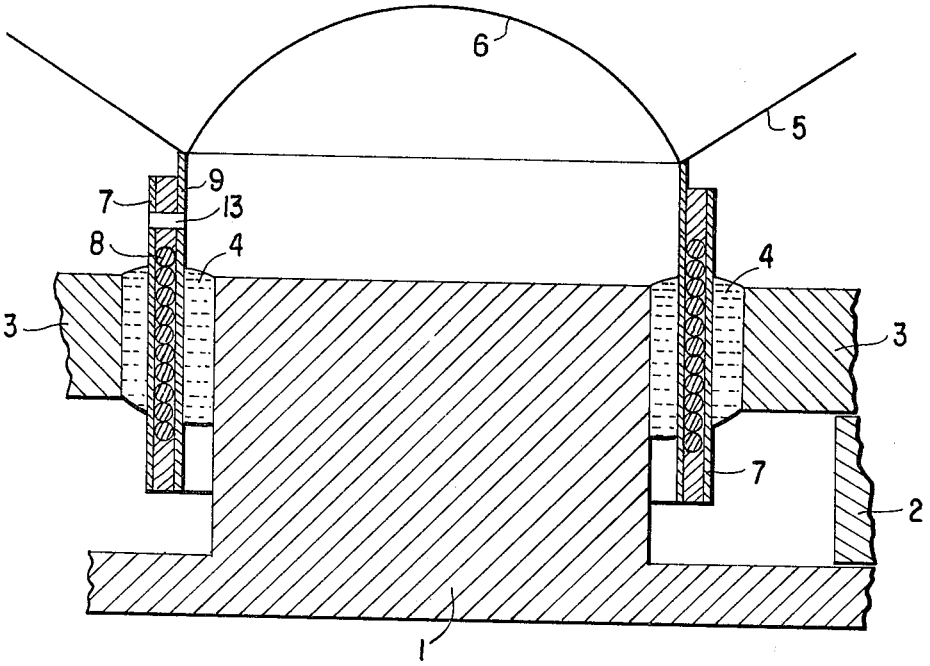
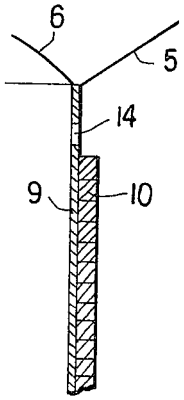
FIG. 2
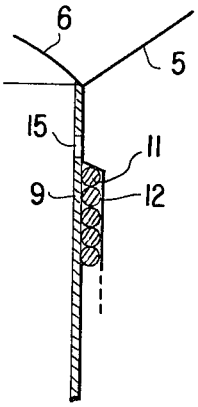
FIG. 3

MOVING COIL DYNAMIC TRANSDUCER

BACKGROUND OF THE INVENTION

The present invention relates to electromagnetic transducers of the type including a member producing a magnetic field and presenting an air gap traversed by the field, a mass of magnetic liquid extending across the air gap, and a moving coil mounted on a moving coil carrier supported for movement through the air gap.

There are known dynamic transducers, specifically loudspeakers as disclosed in German Offenlegungsschrift [Laid-open application] No. 27 40 661.7 in which the area of the magnetic pole element in which the moving coil of the dynamic system moves, an area usually called the "air gap", is filled with fluid on both sides. With the aid of a dosaging, or metering device, the magnetic fluid is introduced separately into the inner and outer air gap regions. The magnetic fluid is retained in the air gap by the permanent magnetic field of the magnetic pole element.

SUMMARY OF THE INVENTION

It is an object of the present invention to simplify introduction of magnetic fluid into a transducer of the above described type.

The above and other objects are achieved, according to the invention, in an electromagnetic transducer including means producing a magnetic field and presenting an air gap traversed by the field, a mass of magnetic liquid extending across the air gap, and a moving coil mounted on a moving coil carrier supported for movement through the air gap, by providing the carrier with at least one passage located to communicate with the magnetic liquid during at least part of the movement of the coil carrier through the air gap for permitting flow of magnetic liquid from one side to the other of the carrier in the direction of the air gap.

It has already been proposed, as disclosed, for example, in German Auslegeschrift [Published application] No. 2,900,427, to provide perforations in the moving coil of a transducer system whose air gap is filled with a magnetic fluid. However, these perforations lie outside the area which can come into contact with the magnetic fluid and are provided to equalize the pressure in a cavity disposed underneath the calotte-shaped part of the transducer.

BRIEF DESCRIPTION OF THE DRAWING

FIG. 1 is a cross sectional view of part of the transducer system of a dynamic bass loudspeaker according to a first preferred embodiment of the invention.

FIGS. 2 and 3 are detail views of two different moving coils with perforations according to embodiments of the invention.

DESCRIPTION OF THE PREFERRED EMBODIMENTS

FIG. 1 is a cross sectional view of a transducer system of a woofer including a conical diaphragm 5, a center calotte 6, and a moving coil unit composed of a carrier 9 connected to the conical diaphragm and moving coil windings 8. The moving coil extends into the air gap of a magnetic pole element which includes a pole core and magnetic base 1, an annular permanent magnet 2 and a pole piece 3. On both sides of the moving coil the air gap is filled with a mass 4 of a magnetic fluid, more specifically a liquid. The moving coil windings 8 enclose carrier 9 and are covered with a smooth foil 7. The magnetic fluid 4 thus does not contact the moving coil windings 8, but rather the smooth foil 7. The foil 7 is glued to the moving coil windings 8, the annular cavity remaining between the foil 7 and the carrier 9 being filled, for example, with the adhesive.

FIGS. 2 and 3 show other ways of providing a smooth surface for the surface of the moving coil. The moving coil winding 10 of FIG. 2 is formed by winding onto the moving coil carrier 9 of a wire having a rectangular cross section. In FIG. 3, the surface of the moving coil windings 11 is smoothed by a lacquer coating 12. The grooves between the individual wire windings of the moving coil 11 are filled with the lacquer material.

The moving coil carrier 9 of FIGS. 1 to 3 is provided with a passage 13, 14, or 15, respectively, outside of the region occupied by the windings of the moving coil. In FIG. 1, the passage 13 is disposed in a region of the moving coil unit 7, 8, 9 which, during normal operation, will be immersed in the fluid 4 during a pulling movement of the moving coil. Thus during operation there occurs an equalization of the quantities of liquid between the regions enclosed by and enclosing the moving coil unit. For introducing the fluid, the moving coil is statically immersed in such a manner that the passage 13 lies in the region of the air gap where fluid is being introduced, so that the fluid will be distributed uniformly to the inside and outside of the unit.

The passages 14 and 15 of FIGS. 2 and 3, however, lie so far removed from the air gap that these passages will not be dipped into the magnetic fluid 4 during a pulling, or retraction, movement of the moving coil under normal operating conditions. For introducing the magnetic fluid, the moving coil is pulled back sufficiently to be immersed in the air gap to such an extent that the magnetic fluid can flow from the one air gap region to the other air gap region, e.g. from the outer to the inner air gap regions. This can be achieved, for example, by applying a direct current of suitable amplitude to the coil windings.

By once filling in a given quantity of magnetic fluid, both regions of the air gap are thus filled with the magnetic fluid. Dosaging, or introduction of a measured amount, is facilitated because a larger quantity, i.e. the entire quantity to be introduced, is supplied at one and the same time. Variations in the moving coil diameter, which result in an increase in the size of one air gap region at the expense of the other region, need not be considered for the dosaging because the correct fill quantity will automatically appear on both sides.

A plurality of passages 13, 14 or 15 may be provided and distributed around the circumference of the moving coil carrier. Instead of in the region of the moving coil carrier which faces the diaphragm, the passages may also be provided in the region facing away from the diaphragm. It is also possible to provide the passage or passages in the region of the windings of the moving coil, if for example two windings are provided. Advantageously, the fluid volumes are then in communication with one another also when the moving coil is in its rest position.

The passages 13, 14 and 15 of FIGS. 1 through 3 simultaneously permit pressure equalization between the air space enclosed below the calotte 6 and the region surrounding the moving coil.

For the magnetic fluid 4 for example the fluid "2 E 0 3" of the manufacturer "Ferrofluidics/Corporation"

may be used. The foil 7 may be made of aluminum foil and for the laquer coating 12 a known expoxy resin with two constituents for example "UHU-plus" may be used.

The extent of immersion of passages 13, 14 or 15 into the magnetic liquid 4 in order to achieve equalization need not have a certain particular value. It is not required that the entire passage is immersed therein. For example, it can be sufficient for the leading edge of the passage to move just into the mass of liquid.

It will be understood that the above description of the present invention is susceptible to various modifications, changes and adaptations, and the same are intended to be comprehended within the meaning and range of equivalents of the appended claims.

What is claimed is:

1. In an electromagnetic transducer including means producing a magnetic field and presenting an air gap traversed by the field, a mass of magnetic liquid extending across the air gap, and a moving coil mounted on a moving coil carrier supported for movement through the air gap, the improvement wherein said carrier is provided with at least one passage located to communicate with the magnetic liquid during at least part of the movement of said coil carrier through the air gap for permitting flow of magnetic liquid from one side to the other of said carrier in the direction of said air gap.

2. Article as defined in claim 1 wherein said passage is located to be out of contact with the magnetic liquid when said coil carrier is in its rest position.

3. Article as defined in claim 1 wherein said passage is located to be out of communication with the magnetic liquid during movement of said coil carrier under normal operating conditions.

4. Article as defined in claim 1 wherein said moving coil winding presents a continuous, smooth surface which extends over the entire region that can be brought into contact with the magnetic liquid and said passage is provided in this region.

5. Article as defined in claim 1 wherein said passage is so located that it simultaneously serves to ventilate a cavity enclosed by said moving coil and a diaphragm of said transducer.

6. In a method of making an electromagnetic transducer including providing means for producing a magnetic field and presenting an air gap traversed by the field, providing a mass of magnetic liquid extending across the air gap, and providing a moving coil mounted on a moving coil carrier supported for movement through the air gap, the improvement comprising providing the carrier with at least one passage located to communicate with the magnetic liquid during at least part of the movement of the coil carrier through the air gap for permitting flow of magnetic liquid from one side to the other of the carrier in the direction of the air gap, and wherein said step of providing a mass of magnetic liquid is carried out by filling in and/or uniformly distributing the magnetic liquid in the air gap by causing the moving coil to perform a movement which brings the passage into the region of the air gap.

7. Method as defined in claim 6 wherein said movement of said moving coil is performed by supplying direct current to the windings of said coil.

* * * * *